United States Patent [19]

Greed

[11] Patent Number: 4,575,701

[45] Date of Patent: Mar. 11, 1986

[54] MICROWAVE SWITCH

[75] Inventor: Robert B. Greed, Colchester, England

[73] Assignee: The Marconi Company Ltd., Stanmore, England

[21] Appl. No.: 498,776

[22] Filed: May 27, 1983

[51] Int. Cl.[4] ..... H01P 1/10

[52] U.S. Cl. ..... 333/258; 333/103; 333/21 R; 333/251

[58] Field of Search ..... 333/101, 103, 251, 258, 333/21 R, 248, 246

[56] References Cited

U.S. PATENT DOCUMENTS

| | | | |
|---|---|---|---|
| 2,877,434 | 3/1959 | Farr et al. | 333/251 |
| 3,187,277 | 6/1965 | Wantuch | 333/251 X |
| 3,346,825 | 10/1967 | Scott et al. | 333/258 |
| 3,701,055 | 10/1972 | Stiles | 333/258 X |
| 3,710,286 | 1/1973 | Aizu et al. | 333/258 X |
| 3,732,508 | 5/1973 | Ito et al. | 333/21 R |

FOREIGN PATENT DOCUMENTS 1438149 7/1976 United Kingdom .

OTHER PUBLICATIONS

"Integrated Fin-Line Millimeter Components" by Paul J. Meier, from IEEE Transactions on Microwave Theory and Techniques, vol. MTT-22, No. 12, Dec. 1974, pp. 1209-1216.

*Primary Examiner*—Paul Gensler

*Attorney, Agent, or Firm*—Spencer & Frank

[57] ABSTRACT

An improved microwave switch incorporating a fin line structure is described. Microwave switches incorporating fin line structures enable microwave energy to be passed to a load or reflected back to the source, by controlling the conductance state of diodes mounted on the fin line structure. The present invention enables the electrical performance of such switches to be greatly improved. The height of a waveguide channel in the vicinity of the fin line structure is very greatly reduced thereby forcing a waveguide mode of propagation into a slot line so that the fin line structure receives substantially all of the energy supplied to the switch. Higher order modes which are generated at the fin line structure are attenuated by lossy material positioned in choke cavities mounted on either side of the fin line structure.

4 Claims, 4 Drawing Figures

MICROWAVE SWITCH

BACKGROUND OF THE INVENTION

This invention relates to a microwave switch which is suitable for controlling microwave energy in a waveguide system. It is particularly difficult to fabricate a microwave switch which is compatible with waveguide structures as this generally requires the provision of high precision moving parts. As an alternative, it has been proposed to utilize a fin line structure, as it is possible to electrically control the conductivity of such a structure without the need to provide mechanically movable parts. Switchable diodes can be used to short circuit opposing edges of a fin line structure, when it is required to render the switch non-conductive. Fin line structures are described in, for example, "Integrated Fin Line Millimeter Components" by P. J. Meier, IEEE Transactions on Microwave Theory and Techniques, Vol. MTT-22, No. 12, December 74. Microwave switches which incorporate fin line structures have not been capable of providing a very high level of electrical performance and in particular in the off state, i.e. when the switch is nominally non-conductive, the impedance which it presents to an applied microwave signal is not sufficiently high for many purposes, as this can have the effect of allowing a relatively low level electrical signal to reach a load. Even though the level of this leakage signal is low, it is very undesirable and quite unacceptable for certain applications. The present invention seeks to provide an improved microwave switch in which this drawback is reduced.

SUMMARY OF THE INVENTION

According to this invention, a microwave switch for controlling the passage of microwave energy includes a waveguide channel dimensioned to support a predetermined waveguide mode of propagation of the microwave energy applied to it; a fin line structure, dimensioned to support a slot line mode of propagation, comprising a pair of co-planar conductive plates mounted across the waveguide channel and lying in the E plane, the two plates being spaced apart by a small distance; switchable means arranged to control the conductivity of the fin line structure; and means for locally modifying the waveguide channel in the vicinity of the fin line structure so as to render it incapable of supporting said predetermined waveguide mode so that the microwave energy is diverted to said fin line structure.

Preferably the means for locally modifying the waveguide channel comprises a portion of the waveguide channel in which its height, in a direction perpendicular to the E plane direction, is very much reduced in the region of the fin line structure. This can be achieved by locally deforming the outer wall of the waveguide channel or alternatively by inserting into the channel a suitably shaped conductive plate or block. The presence of the means for locally modifying the waveguide channel prevents propagation of the fundamental waveguide mode and ensures that the applied microwave energy is diverted to the fin line structure so that it can be controlled by the switchable means by the switching arrangement.

Harmonic waveguide modes of propagation may be generated to a certain extent, although their amplitude as compared with that of the fundamental mode is very small, as in a conventional switch utilising a fin line structure.

The means for locally modifying the waveguide channel also suppresses these harmonic modes. To further improve the attenuation of the harmonic modes, an absorbtive (lossy) material is mounted in cavities positioned in the vicinity of the fin line structure.

The switchable means can comprise one or more switchable diodes mounted to bridge the two plates of the fin line structure—these can be termed shunt mounted diodes. At relatively low microwave frequencies, microwave energy passes through the switch while the diode (or diodes) is non-conductive, whereas it is reflected back to the input port while the diode is held in its conductive state. Because all diodes possess inductance, the effect can be reversed at higher frequencies; that is to say, the switch is conductive while the diode is conductive and vice versa. Thus the switchable means has to be designed with the operating frequencies of the switch in mind.

Instead of using shunt mounted diodes, it is possible to mount one or more diodes to bridge discontinuities in one or both of the two plates which comprise the fin line structure. Such an arrangement of diodes is termed series mounted diodes.

The microwave switch can be used to route energy to different ones of a plurality of input or output ports, as opposed to operating as a simple on-off switch.

DESCRIPTION OF THE PREFERRED EMBODIMENTS

Figure 1:
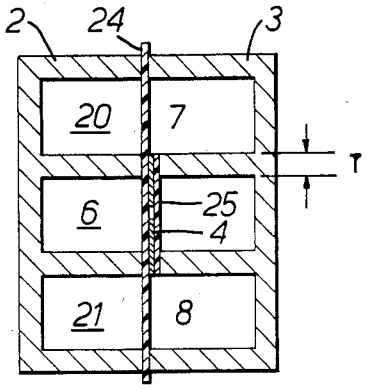
FIG. 1. (PRIOR ART)
FIGS. 1 and 2 show sectional and perspective views respectively of a known microwave switch.
Figure 2:
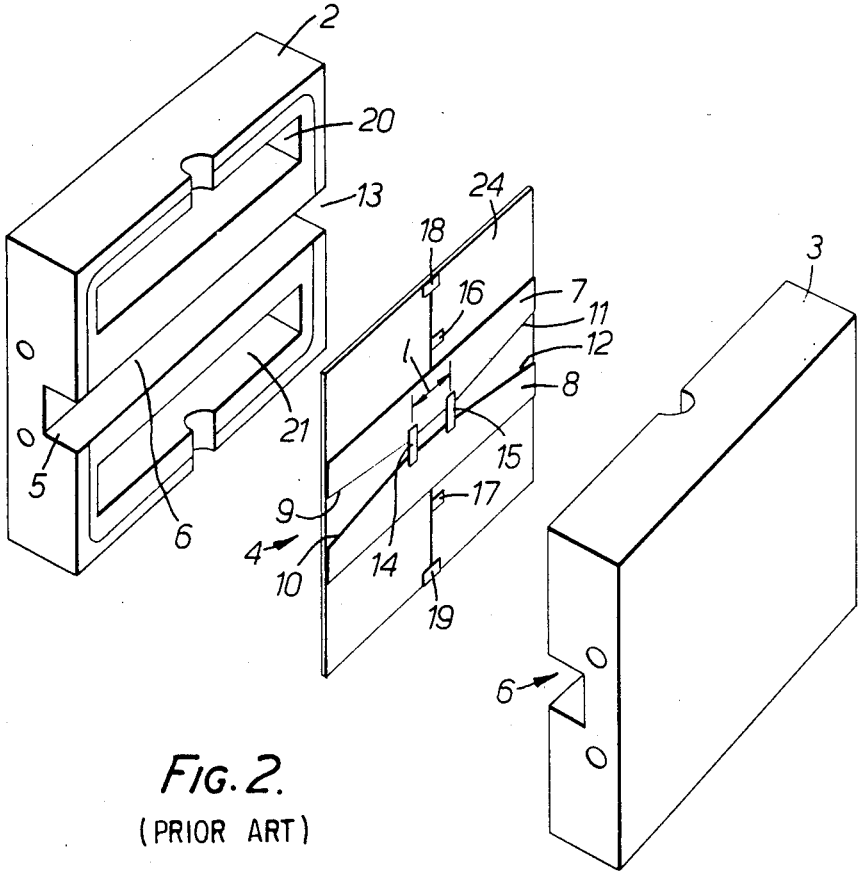
FIG. 2. (PRIOR ART)

Referring to FIG. 1, which shows a sectional view, and FIG. 2 which is an exploded perspective view, a microwave switch comprises two large blocks of conductive material 2 and 3 which are arranged to sandwich between them a fin line structure 4. Thin sheets of dielectric material 24, 25 are positioned on either side of the fin line structure 4, so as to electrically insulate it from the two blocks 2 and 3. In use, microwave energy is applied to an input port 5 of a microwave channel 6, which is dimensioned so as to support a predetermined waveguide mode of propagation. In this connection the term microwave includes millimetric frequencies. The fin line structure 4 consists of two coplanar plates 7 and 8 mounted in the E plane direction of the waveguide channel 6. For convenience the plates 7 and 8 are supported by the larger dielectric sheet 24. In some cases it may be more convenient to form the plates 7 and 8 respectively as thin conductive foils on opposite sides of a single thin insulating film of dielectric material—as the film is very thin, the two plates are still effectively coplanar. The fin line has the effect of converting the waveguide mode of propagation to a slot line mode of propagation, and the two plates 7 and 8 are provided with edges surfaces 9 and 10 of a tapering profile adjacent to the input port 5 so as to avoid abrupt transitions occurring in the propagation of the microwave energy. Thus the microwave energy travels over the central portion of the fin line structure in a slot line mode, and is then progressively converted back to a waveguide mode of propagation by a further pair of tapering edges 11 and 12, so that the original waveguide mode of propagation is made available at an output port 13 of the waveguide channel 6.

Two diodes 14 and 15 are mounted so as to electrically bridge the two plates 7 and 8, and bias circuits 16 and 17 (which may include suitable filters) are arranged so as to permit the two diodes to be either biassed into conduction or non-conduction depending on the polarity and magnitude of bias voltages applied at contacts 18 and 19. If the two diodes 14 and 15 are held non-conductive, the microwave energy applied at input port 5 travels through the switch to a load (not shown) via port 6 with very little attenuation. However, if the two diodes are rendered conductive, the microwave energy is reflected back to its source and very little energy reaches the load. Additional diodes can be provided to enhance the switching action if needed.

To minimize the loss of microwave energy while the switch is in its conductive state, two r.f. choke circuits in the form of cavities 20 and 21 are provided. The thickness of the wall "T" is made equal to $\lambda/4$ where $\lambda$ is the wavelength of the applied signal. These cavities operate to ensure the existence of an effective radio frequency short circuit between the fin line structure itself and the adjacent waveguide walls. Unfortunately, although these chokes are essential, their presence enables many more modes of propagation to exist. In particular, harmonic modes of propagation can now bypass the fin line structure and reach a load even while the switch is nominally in its non-conductive state.

These leakage levels of microwave energy can be very small indeed, but are still unacceptable for certain applications. A microwave switch which is modified in accordance with this invention is illustrated in FIG. 3, and it permits the performance level to be substantially enhanced to levels which enable very stringent performance requirements to be met.

Figure 3:
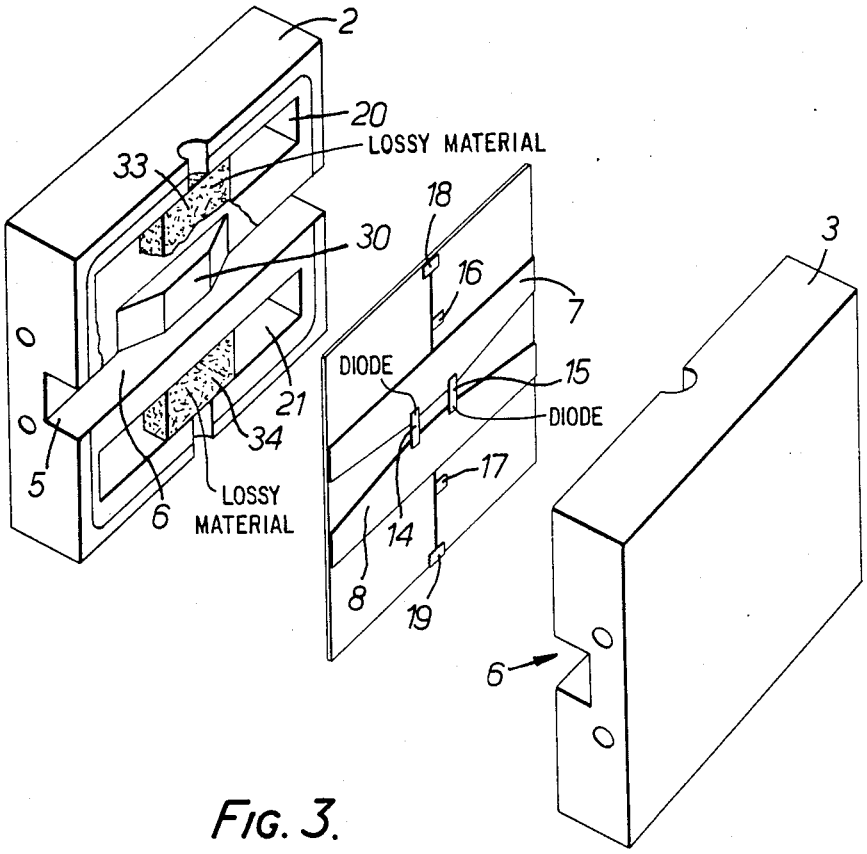
FIG. 3 shows a perspective view of a microwave switch in accordance with this invention.

Referring to FIG. 3, the reference numerals of FIGS. 1 and 2 are used to identify like parts. The main point of difference shown in FIG. 3 comprises two side wall blocks 30 mounted adjacent to the fin line structure (part of the cavity wall is cut away so that one block 30 can be seen, but the other block, which is mounted within the block 3, is not visible). Each block has a height which is somewhat less than the corresponding depth of the waveguide channel so that the tops of the blocks do not contact the fin line structure itself. Each end of each block 30 is tapered as shown, to give a more gradual transition to and from the slot line mode. Although in this example, both blocks 30 are electrically connected to the walls of the channels 6, they can be electrically insulated from it. Both blocks 30, are however, formed of a material having a good electrical conductivity. The presence of these blocks prevents propagation of the waveguide mode along the waveguide channel, and forces the microwave energy wholly into a slot line mode, so that it is conducted along the fin line structure. In this way virtually all of the energy applied to the switch is controlled by the action of the diodes 14 and 15.

Even so, some of the harmonic modes continue to exist and these can by-pass the fin line structure by passing along the choke cavities 20 and 21. Lossy absorbent material 33 and 34 is positioned in each choke cavity to absorb this energy and to prevent the excitation of harmonic modes of any appreciable energy. Similar blocks, not shown, are mounted in the waveguide structure 3 in an exactly analogous manner. Any suitable lossy material can be used, such as Marconi Absorber type Y33-1980.

The effect of the side wall blocks 30 and the lossy material is to very greatly enhance the performance of the switch. Although the conductivity of the switch in its "on" state remains very high, its effective transmissive impedance in the "off" state becomes very high indeed, and reduces energy leakage to a load of harmonic modes to an extremely low level.

Figure 4:
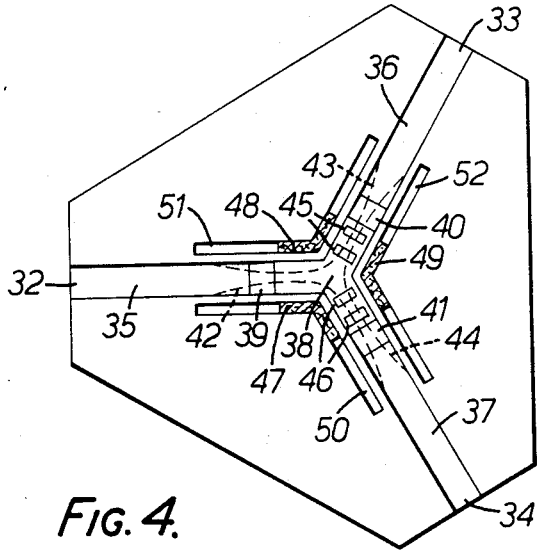
FIG. 4 shows an alternative kind of switch.

A three port switch is shown in FIG. 4. It has one input port 32, and two output ports 33 and 34. The general principle of operation is very similar to that of the switch shown in FIG. 3, but three waveguide channels 35, 36, 37 meet at a point where a side wall block 38 is positioned. In FIG. 4, only the bottom half of the switch structure is shown, and in practice an additional block is placed above that of the block 38, with a fin line structure between them. As before, the block 38 has tapered ends 39, 40, 41. The fin line structure is shown in broken line—it consists of three plates 42, 43, 44, with the plates being bridged by switchable diodes 45, 46 placed in the two channels 36, 37 leading to the output ports 33, 34. By controlling the state of the diodes, microwave energy can be routed to either output port, or even shared between them. Absorbtive (lossy) material 47, 48, 49 is positioned in cavities 50, 51, 52 adjacent to the fin line structure, in a manner analogous to that of FIG. 3.

What I claim is:

1. A microwave switch including a waveguide channel dimensioned to support a predetermined waveguide mode of propagation of the microwave energy applied to it; a fin line structure, dimensioned to support a slot line mode of propagation, comprising a pair of co-planar conductive plates mounted across the waveguide channel and lying in the E plane, the two plates being spaced apart by a small distance; switchable means associated with at least one of said conductive plates and arranged to control the conductivity of the switch; and means for locally modifying the waveguide channel in the vicinity of the fin line structure so as to render it incapable of supporting said predetermined waveguide mode so that the microwave energy is diverted to said fin line structure, wherein said means for locally modifying includes a pair of conductive blocks, one mounted on either side of said fin line structure, to very much reduce the height, in a direction perpendicular to the E plane direction, of a portion of the waveguide channel in the region of the fin line structure.

2. A switch as claimed in claim 1, wherein said switch has input and output ports and wherein the ends of the blocks are shaped so as to present tapered transition regions to the input and output ports of the switch.

3. A switch as claimed in claim 1 and wherein the blocks are electrically connected to the waveguide channel.

4. A switch as claimed in claim 1 and wherein a pair of choke cavities are provided externally of the waveguide channel in the region of the fin line structure, and wherein each choke cavity contains lossy material so as to attenuate harmonic modes of the microwave energy applied to the switch.

* * * * *